United States Patent [19]

Gillaspy et al.

[11] Patent Number: 4,872,634

[45] Date of Patent: Oct. 10, 1989

[54] BRACING FOR TILT-UP WALL PANEL

[75] Inventors: Kenton P. Gillaspy; David L. Kelly, both of Sacramento, Calif.

[73] Assignee: The Burke Company, Sacramento, Calif.

[21] Appl. No.: 238,333

[22] Filed: Aug. 29, 1988

[51] Int. Cl.[4] ..... F16M 13/00

[52] U.S. Cl. ..... 248/354.3; 52/127.2

[58] Field of Search ..... 248/354.3, 354.1, 351, 248/357; 52/749, 742, 745, 514, 127.2, 127.5

[56] References Cited

U.S. PATENT DOCUMENTS

| | | | |
|---|---|---|---|
| 1,762,740 | 6/1930 | Rains | 248/354.3 X |
| 3,030,061 | 4/1962 | Jennings | 248/354.3 |
| 3,700,202 | 10/1972 | Donnels | 248/354.3 |
| 3,817,006 | 6/1974 | Williams | 248/354.3 X |
| 4,068,427 | 1/1978 | Camardo | 52/749 X |
| 4,083,156 | 4/1978 | Tye | 52/127.2 |

*Primary Examiner*—Ramon O. Ramirez

*Attorney, Agent, or Firm*—Limbach, Limbach & Sutton

[57] ABSTRACT

A wall brace includes an elongated main brace that has a mounting bracket at one end for securing to a wall panel and a mounting bracket at the other end for securing to a floor. The wall brace further includes two lateral bracing legs each pivotably coupled at one end to the center of the main brace and each having a mounting bracket at the other end for securing that end of the lateral bracing leg to either the floor or the wall panel.

6 Claims, 1 Drawing Sheet

BRACING FOR TILT-UP WALL PANEL

BACKGROUND OF THE INVENTION

1. Field of the Invention

This invention relates generally to apparatus for temporarily bracing walls during construction, and relates more particularly to an improved bracing apparatus having a main brace plus two lateral bracing legs.

2. Description of the Relevant Art

One common construction technique relating to the erection of buildings involves first fabricating horizontal panels and then tilting those panels to a vertical orientation for use as the walls of the building. An important advantage of this technique is that the wall panel can often be fabricated much easier when it is horizonta, where heavy structural members can be more easily handled. Concrete slab walls are typically constructed with this technique.

An important aspect of this construction technique is the need to provide bracing for the tilt-up panels while other panels and connecting structure is being erected. For this purpose, temporary braces are commonly used that extend obliquely from the panel to the adjacent floor. Even if the tilt-up panel is vertical and its weight is fully supported by the floor, the temporary brace must be sturdy enough to counteract winds loads or the like. A common failure mode for a temporary brace is buckling under compressive loading.

SUMMARY OF THE INVENTION

In accordance with the illustrated preferred embodiment, the present invention provides an improved wall brace for temporarily bracing a wall panel with respect to a floor. The wall brace includes an elongated main brace that has a mounting bracket at one end for securing to a wall panel and a mounting bracket at the other end for securing to a floor. The wall brace further includes two lateral bracing legs each pivotably coupled at one end to the center of the main brace and each having a mounting bracket at the other end for securing that end of the lateral bracing leg to the floor or wall panel.

The lateral bracing legs significantly increase the load bearing capacity of a long main brace by laterally supporting the center of the brace. The lateral bracing legs restrict the main brace from bowing caused by compressive loading, bowing that could otherwise lead to collapse of the brace due to buckling. The wall brace of the present invention is easily disassembled for transport.

The features and advantages described in the specification are not all inclusive, and particularly, many additional features and advantages will be apparent to one of ordinary skills in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENTS

Figure 1:
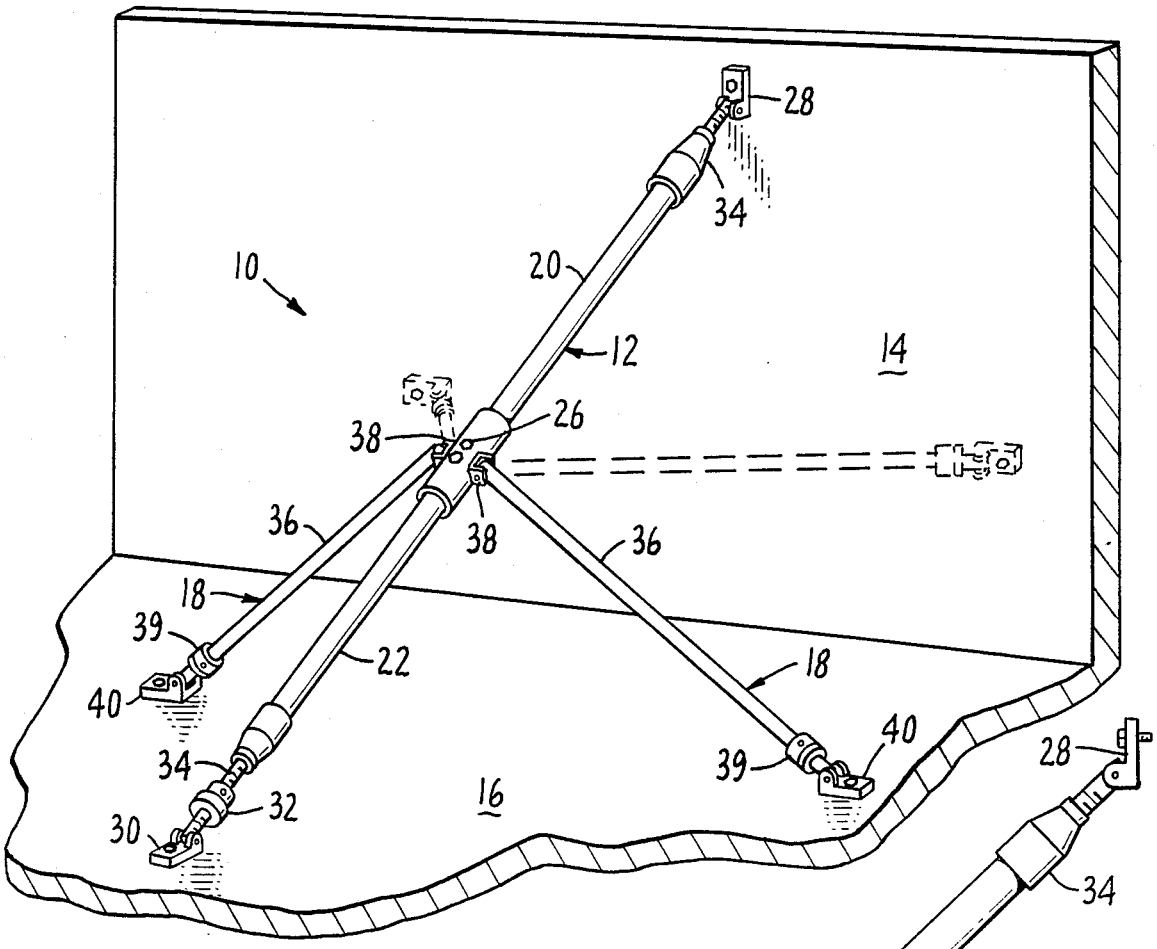
FIG. 1 is a perspective view of a wall brace according to the present invention.
Figure 2:
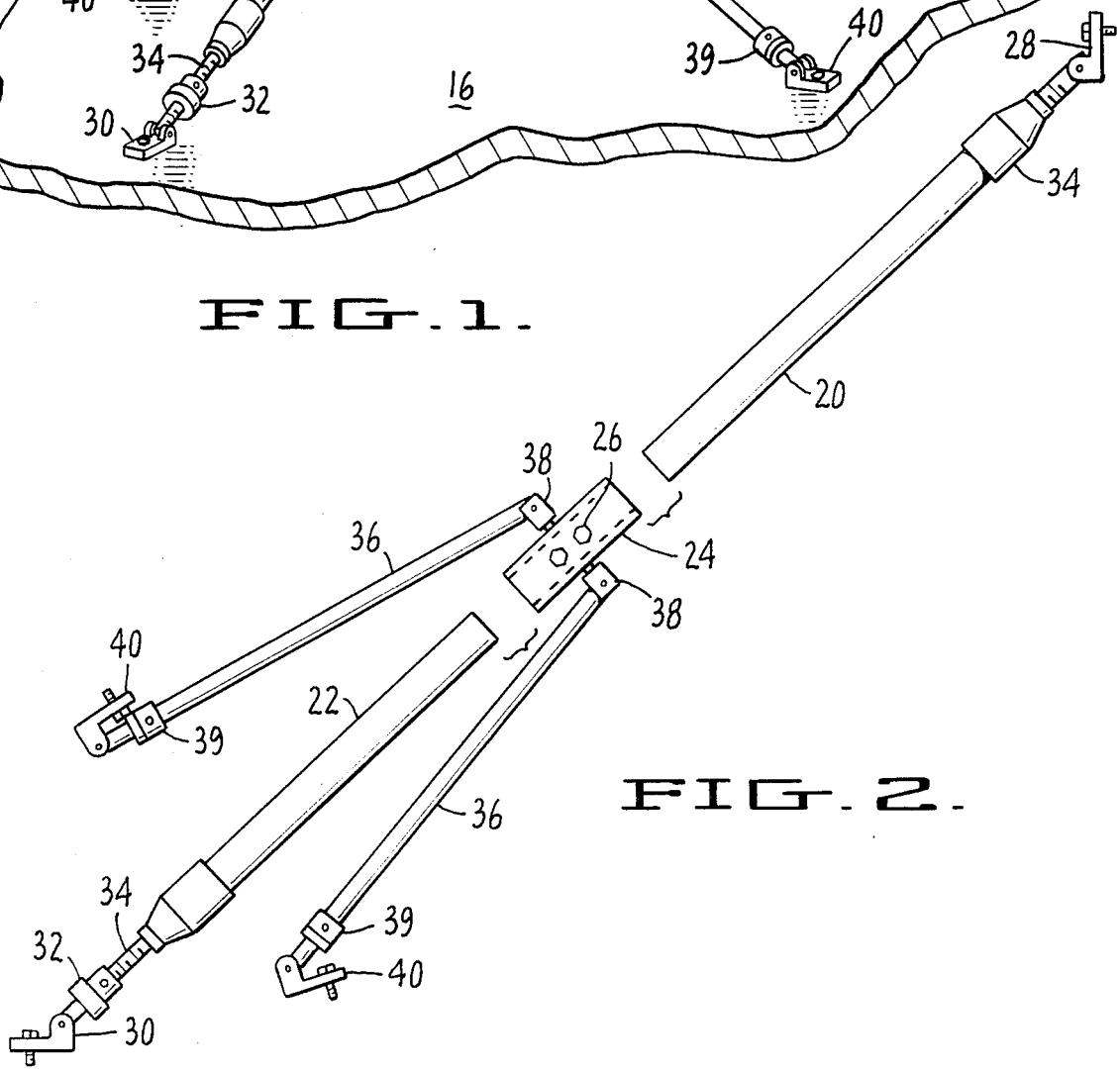
FIG. 2 is an exploded view of the wall brace of the present invention.

FIGS. 1 and 2 of the drawings depict a preferred embodiment of the present invention for purposes of illustation only. One skilled in the art will readily recognize from the following discussion that alternative embodiments of the structures and methods illustrated herein may be employed without departing from the principles of the invention described herein.

The preferred embodiment of the present invention is a wall brace that includes two lateral bracing legs. As shown in FIGS. 1 and 2, the wall brace 10 of present invention includes a main brace 12 that, when installed, extends from a wall panel 14 to a floor 16, and two lateral bracing legs 18 that extend from near the center of the main brace to the floor or wall panel. The main brace 12 supports the wall panel 14, while the lateral bracing legs 18 provide lateral bracing for the main brace, thus increasing its load carrying capacity.

In the preferred embodiment, the main brace includes two elongated members 20 and 22, which are preferably composed of steel tubing. The two elongated members 20 and 22 are rigidly joined by a splice sleeve 24, which is a tube having an inner diameter slightly greater than the outer diameter of the two elongated members. Two bolts or set screws 26, threaded through the wall of the splice sleeve, hold the two elongated members 20 and 22 in place. At the end of elongated member 20 nearest the wall panel 14 is a mounting bracket 28 that attaches the brace to the wall. At the opposite end of the main brace is another mounting bracket 30 that attaches the main brace to the floor. A swivel joint 32 is provided at the floor end of the main brace 12 so that the brace can be swiveled into proper position with the mounting brackets 28 and 30 resting flat on the wall panel and floor. Two threaded couplings 34 are provided at the ends of the main brace 12 to allow the length of the main brace to be adjusted.

Each of the two lateral legs 18 extend from the splice sleeve 24 to the floor 16 or wall panel 14 to provide lateral bracing of the main brace 12. Each lateral bracing leg has an elongated member 36 that is pivotably coupled at one end to the splice sleeve by a clevis 38. The other end of each elongated member 36 is attached to swivel 39 and a mounting bracket 40. The mounting bracket attaches to the floor or wall panel using drill-in expansion anchors or similar means, while the swivel allows the mounting bracket to rest flat on the floor or wall panel.

When the wall brace 10 is not in use, it can be disassembled for easy transport between job sites. One of the elongated members 20 or 22 can be removed by loosening the appropriate bolt 26 on the splice sleeve 24. The lateral bracing legs 18 can be folded next to the remaining elongated member and secured in place.

From the above description, it will be apparent that the invention disclosed herein provides a novel and advantageous apparatus for bracing tilt-up panels. The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. A wall bracing apparatus for bracing a wall panel with respect to a floor, said apparatus comprising:

an elongated main brace including wall mounting means disposed at one end thereof for securing that end of the main brace to a wall panel, and including floor mounting means disposed at the other end thereof for securing that end of the main brace to a floor; and two elongated lateral bracing legs of equal length, each coupled by a two-axis pivot at one end of the lateral bracing leg to the main brace at a location between the two ends of the main brace, and each including mounting means separate from the wall and floor mounting means disposed at the other end of the lateral bracing leg for securing that end of the lateral bracing leg to the floor or wall panel at a position spaced laterally apart from the vertical plane of the main brace.

2. A wall bracing apparatus as recited in claim 1 wherein the main brace includes two elongated members joined together by a splice sleeve, and wherein the lateral bracing legs are joined at one end by the two-axis pivot to opposite sides of the splice sleeve.

3. A wall bracing apparatus as recited in claim 1, wherein the lateral bracing legs are coupled to the main brace at a location near the center of the main brace.

4. A wall bracing apparatus as recited in claim 1 wherein the lateral bracing legs are coupled to the main brace by a joint that allows the legs to be folded against the main brace.

5. A wall bracing apparatus operable for bracing a wall panel with respect to a floor, said apparatus comprising:

an elongated main brace including first and second elongated members of substantially the same length, a splice sleeve that rigidly joins together the two elongated members, wall mounting means disposed at the end of the first elongated member opposite the splice sleeve for securing that end of the main brace to a wall panel, and floor mounting means disposed at the end of the second elongated member opposite the splice sleeve for securing that end of the main brace to a floor; and two elongated lateral bracing legs each pivotably coupled by a two-axis pivot at one end of the lateral bracing leg to opposite sides of the splice sleeve of the main brace, and each including mounting means separate from the wall and floor mounting means disposed at the other end of the lateral bracing leg for securing that end of the lateral bracing leg to the floor or wall panel at a position spaced laterally apart from the vertical plane of the main brace.

6. A wall bracing apparatus operable for bracing a wall panel with respect to a floor, said apparatus comprising:

an elongated main brace including first and second elongated members of substantially the same length and a splice sleeve that rigidly joins together the two elongated members;

wall mounting means disposed at the end of the first elongated member opposite the splice sleeve for securing the end of the main brace to a wall panel and floor mounting means disposed at the end of the second elongated member opposite the splice sleeve for securing that end of the main brace to a floor, wherein the wall mounting means and floor mounting means each include screw adjustment means for adjusting the distance between the wall mounting means and floor mounting means; and two inextensible lateral bracing legs each pivotably and rotatably coupled at one end thereof to opposite sides of the splice sleeve of the main brace and each including mounting means disposed at the other end thereof for securing that end of the lateral bracing leg to the floor or wall panel at a location spaced laterally apart from and on opposite sides of the vertical plane of the main brace.

* * * * *